US005170020A

United States Patent [19]

Kruger et al.

[11] Patent Number: 5,170,020

[45] Date of Patent: Dec. 8, 1992

[54] RAINPROOF EXHAUST PIPE

[75] Inventors: Allan J. Kruger, Beaver Dam; James P. Lob, Oconomowoc, both of Wis.

[73] Assignee: Deere & Company, Moline, Ill.

[21] Appl. No.: 665,618

[22] Filed: Mar. 5, 1991

[51] Int. Cl.[5] ..... F01N 5/00

[52] U.S. Cl. ..... 181/211; 181/227; 181/247; 181/267

[58] Field of Search ..... 181/211, 231, 235, 227, 181/247, 264, 267

[56] References Cited

U.S. PATENT DOCUMENTS

| | | | |
|---|---|---|---|
| 2,732,913 | 1/1956 | Higgins | 181/211 |
| 3,792,722 | 2/1974 | Harmon | 181/227 |
| 4,970,859 | 11/1990 | Yates et al. | 60/324 |

*Primary Examiner*—L. T. Nix
*Assistant Examiner*—Khanh Dang

[57] ABSTRACT

A vertical exhaust pipe having an inner pipe with an upper opening. An outer pipe is positioned around the inner pipe and has an end portion that extends beyond the upper opening in the inner pipe, said end portion defining an outlet through which exhaust gas exits the outer pipe. A mechanism is coupled with the inner pipe for blocking rain that has entered the outer pipe from falling through the opening in the inner pipe. A ledge mechanism is positioned beneath the upper opening in the inner pipe and between the inner and outer pipes for forming a chamber within which is held rainwater that has entered the outer pipe. A drainage mechanism allows rainwater in the chamber to pass to the exterior of the outer pipe.

24 Claims, 2 Drawing Sheets

RAINPROOF EXHAUST PIPE

BACKGROUND OF THE INVENTION

1. Field of the Invention

The invention relates to vertically disposed exhaust pipes as used on off-road vehicles.

2. Description of the Related Art

Vehicles having a power source such as an internal combustion engine are typically provided with an exhaust pipe that discharges exhaust fumes into the atmosphere. Many such vehicles, such as automobiles, provide exhaust pipes that are horizontally disposed beneath the vehicle, such that the operator and passers-by are hindered from touching the hot exhaust pipe. Many off-road vehicles, such as tractors, are provided with vertically disposed exhaust pipes for dispersing exhaust fumes above the head of the operator. The warm fumes rise as they exit the exhaust pipe and therefore do not cause discomfort to the operator, or damage to growing vegetation.

However, rain can accumulate in vertical exhaust pipes during periods of non-use. Rain water can flow down the inside of the pipe to the exhaust manifold within the engine, and cause difficulty in starting the engine. Also, when the engine is started, the water that has accumulated in the exhaust pipe is ejected from the pipe by the exhaust gases that are forced out of the pipe. The ejected water particles can be dirty since the rainwater in the pipe mixes with the exhaust soot that builds up within the pipe. This sooty moisture ejected from the exhaust pipe can undesirably soil or stain the operator or structures that are close to the exhaust pipe when the vehicle engine is started.

It is known to provide a flapper lid for a vertical exhaust pipe that acts to prevent rainwater from entering the pipe. Such a mechanism includes a lid hinged to the opening at the top of the exhaust pipe. The weight of such a lid keeps it closed over the exhaust pipe opening to exclude rain from entering during periods of non-use. When the engine is started the exhaust fumes flow upwardly within the pipe and press against the lid to pivot the lid to an opened position. The fumes are thereby allowed to exit the exhaust pipe. A hinged lid adds weight to the top of the pipe and raises the center of gravity of the exhaust pipe. Exhaust pipes with hinged lids may therefore require the use of stronger support structures for coupling the pipe to the vehicle in order to keep the pipe upright when used with large power sources that create a large amount of vibration, or during operation over rough terrain. Hinged lids can also be relatively costly to manufacture and attach to exhaust pipes, and may be perceived as unsightly.

Therefore, it would be desirable to provide a vertical exhaust pipe that substantially eliminates the problem of rainwater being ejected from the exhaust pipe when the engine is started. It would be desirable for such a mechanism to be provided such that the center of gravity of the exhaust pipe is not significantly raised. The support structure would therefore not need to be reinforced or strengthened when used on small vehicles. It would be desirable for such a mechanism to outwardly resemble a conventional upright exhaust pipe during normal operation. It would also be desirable for such a mechanism to be simple in construction and relatively inexpensive to manufacture and assemble.

SUMMARY OF THE INVENTION

A vertically disposed exhaust pipe is provided for reducing the amount of sooty moisture that is ejected from the exhaust pipe when the engine is started after being stored in a rainy environment. An inner pipe is coupled to the exhaust manifold of the vehicle power source. The inner pipe has an upper opening through which exhaust gas flows. An outer pipe is positioned around the inner pipe and has an end portion that extends upwardly beyond the upper opening in the inner pipe. An outlet is formed in the end portion of the outer pipe for allowing exhaust gas to enter the environment. A plate is fixed to the inner pipe to block the rainwater that has entered the outer pipe from entering the inner pipe. A ledge means is positioned between the inner and outer pipes and beneath the upper opening in the inner pipe. The ledge means and the inner and outer pipes define a chamber that collects the water that has accumulated within the outer pipe. A drainage means or orifice is provided for allowing the water within the chamber to drain out of the outer pipe.

DESCRIPTION OF THE PREFERRED EMBODIMENT

Figure 1:
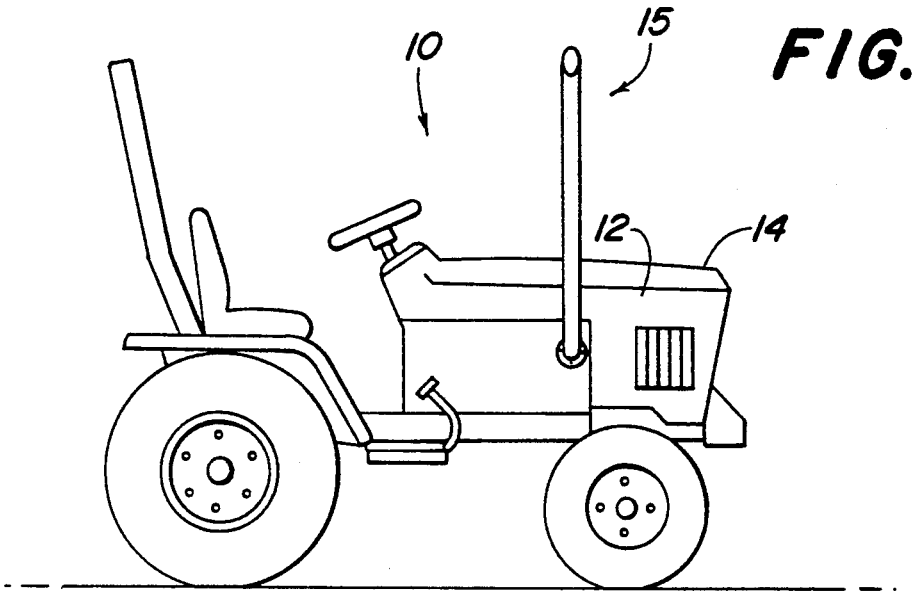
FIG. 1 shows a vehicle with which the present invention may be used.

Referring to FIG. 1, there is shown a vehicle 10 usable with the present invention. The vehicle 10 has a power source 12 such as an internal combustion engine carried beneath an enclosure 14. A vertically disposed exhaust pipe 15 is coupled with the engine 12 and acts to channel exhaust fumes from the engine 12 to the atmosphere.

Figure 2:
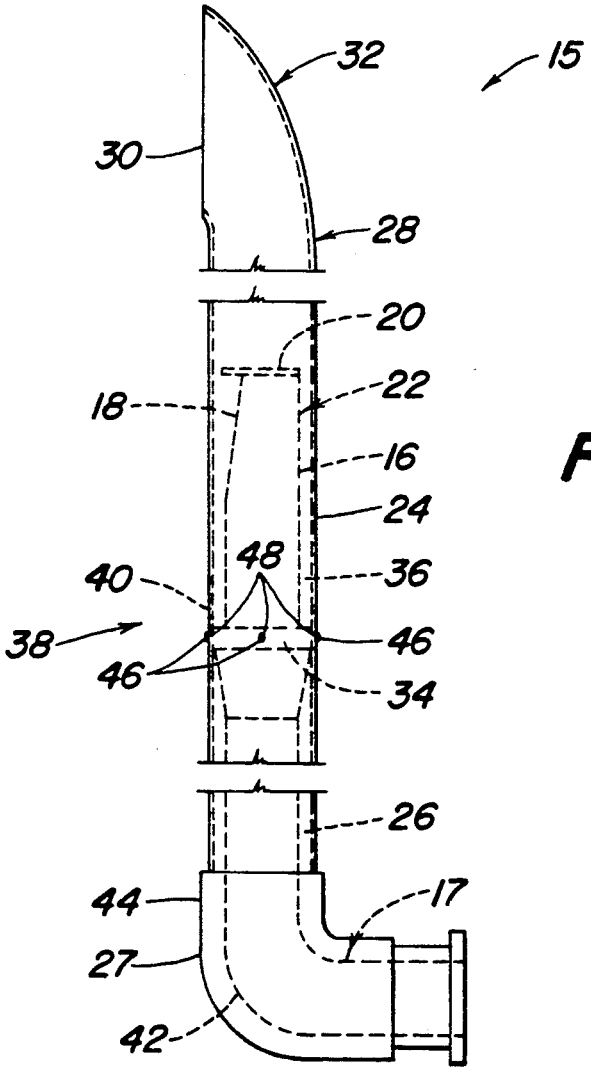
FIG. 2 is a side view of the present invention.
Figures 3, 4:
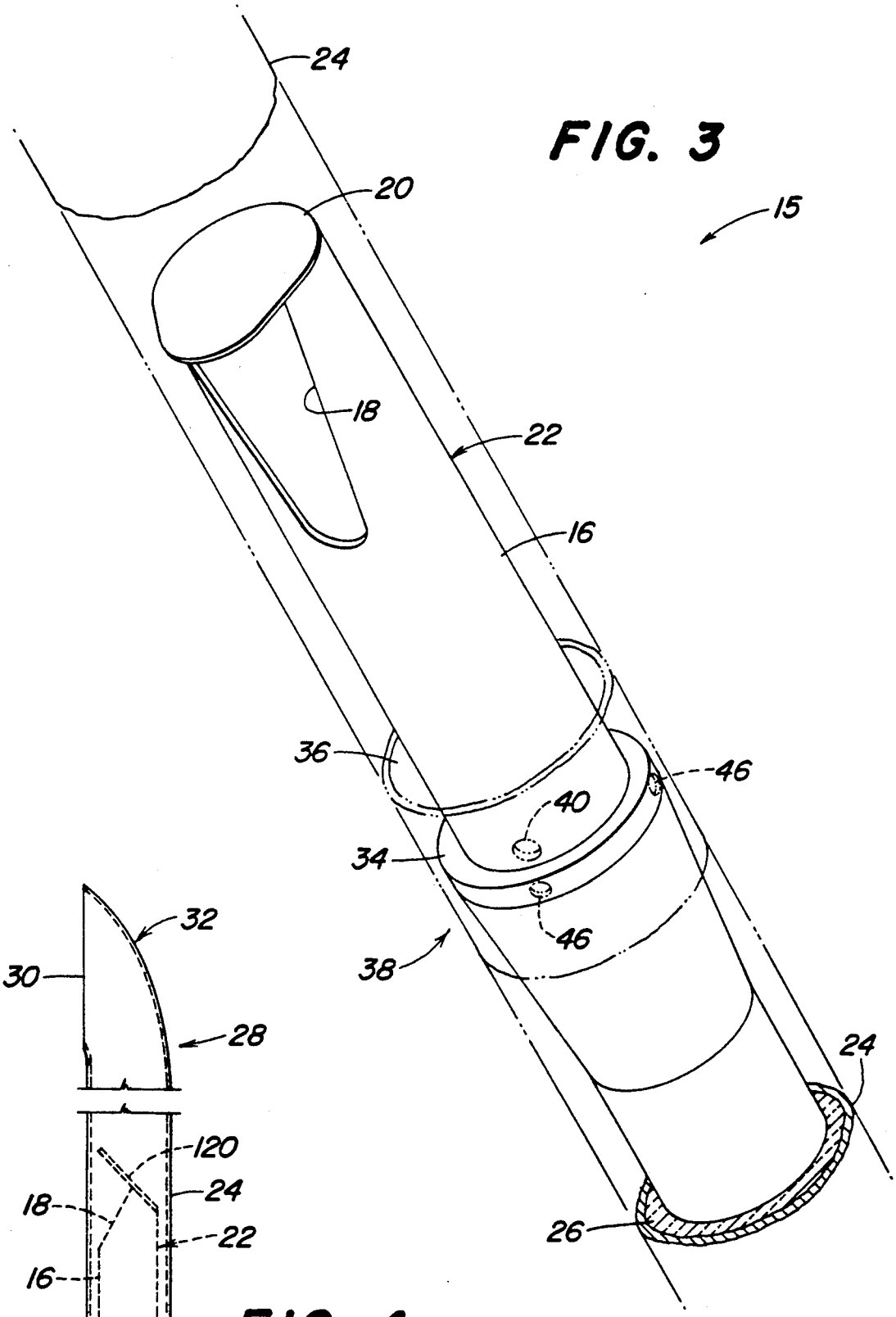
FIG. 3 is a perspective view of the present invention with a portion of the outer pipe shown in phantom.
FIG. 4 shows an alternative embodiment of the present invention.

Referring now to FIGS. 2 and 3, there is shown the preferred embodiment of the exhaust pipe 15 according to the present invention. An inner pipe 16 has a lower end portion 17 coupled with the engine 12 to receive exhaust fumes. The inner pipe 16 extends upwardly and defines an upper opening 18 through which the exhaust gas exits the inner pipe 16. The upper opening 18 of the preferred embodiment is formed in the side of the inner pipe 16. A blocking means or plate 20 is positioned at the upper end portion 22 of the inner pipe 16 and above the upper opening 18. The plate 20 forms a cover for the upper portion 22 of the inner pipe 16 and extends laterally over the upper opening 18 in the side of the inner pipe 16.

The preferred embodiment of the present invention provides an outer pipe 24 positioned around the inner pipe 16. The outer pipe 24 has a lower end portion 27, and an end portion 28 that extends upwardly beyond the upper opening 18 in the inner pipe 16. An outlet 30 is formed in the portion 28 end portion 28 of the outer pipe 24 for allowing exhaust gases to flow into the environment. The upper end portion 28 of the outer pipe 24 according to the preferred embodiment forms a bend portion 32 and has the outlet 30 positioned on the side of the outer pipe 24.

A ledge means or shoulder member 34 is provided in the preferred embodiment of the present invention, and is positioned below the upper opening 18 in the inner pipe 16. The ledge means 34 is positioned between the inner and outer pipes 16, 24 and acts as a ledge upon which rainwater in the outer pipe 24 comes to rest. Rainwater that enters the outer pipe 24 collects in a chamber 36 defined by the ledge means 34 and inner and outer pipes 16, 24. Drainage means 38 is provided for allowing the rainwater that has collected in the chamber 36 to exit the outer pipe 24. The preferred embodiment of the present invention provides an orifice 40 through which the rainwater passes to the exterior of the outer pipe 24. Insulation 26 extends downwardly from the ledge means 34 and is positioned between the inner and outer pipes 16, 24 to reduce the temperature of the outer pipe 24.

Next, the operation of the preferred embodiment will be discussed. During periods of non-use, a vehicle 10 provided with the present invention may be stored outdoors in a rainy environment. The bend 32 in the end portion 28 of the outer pipe 24 prevents rain from traveling straight downwardly into the outer pipe 24. However, windy conditions may drive rain laterally into the outlet 30 of the outer pipe 24. Once inside the outer pipe 24, the rainwater will continue to fall downwardly through the air, and will also run down the inside walls of the outer pipe 24.

The preferred embodiment acts to prevent rainwater that has fallen into the outer pipe 24 from entering the inner pipe 16. A space is provided between the inner and outer pipes 16, 24 such that the water that has collected on the inside walls of the outer pipe 24 will run downwardly along the outer pipe 24 and past the inner pipe's opening 18. Rain may also fall within the outer pipe 24 without contacting the walls of the outer pipe 24. The rainwater that falls through the air in the outer pipe 24 is blocked from entering the inner pipe 16 by the presence of the plate 20. The plate 20 acts to cover the upper end portion 22 of the inner pipe 16 and extends laterally over the opening 18 in the side of the inner pipe 16. The laterally extending portion of the plate 20 thereby acts as a shield or a barrier that blocks airborne rainwater from entering the inner pipe's opening 18. Rain traveling with a straight trajectory into the outer pipe's outlet 30 will be prevented from traveling into the inner pipe 16 by the presence of the plate 20. Therefore, falling rainwater would have to change direction within the outer pipe 24 in order to get around the edge of the plate 20 to enter the inner pipe's opening 18. The plate 20 extends laterally beyond the inner pipe's opening 18 such that as water drips over the edge of the plate 20 it will fall past the opening 18, and not into the inner pipe 16. Water is thereby prevented from flowing into the inner pipe 16.

A means is also provided for allowing the water to exit the outer pipe 24. A ledge means 34 is positioned beneath the inner pipe's opening 18 and defines a chamber 36 between the inner and outer pipes 16, 24. The water that has passed by the inner pipe's opening 18 will collect in the chamber 36. Drainage means 38 is provided for allowing the water in the chamber 36 to flow out of the outer pipe 24. An orifice 40 is provided in the preferred embodiment to accommodate the flow of water through the outer pipe 24. The orifice 40 allows water to flow out of the outer pipe 24 and prevents the water from accumulating in the chamber 36 to the point of flowing into the inner pipe's opening 18.

Next, the manufacture and assembly of the present invention will be discussed. The inner pipe 16 is formed with a bend 42 at its lower end portion for coupling with the power source exhaust manifold. The ledge means 34 is positioned around the inner pipe 16 and welded or otherwise fixed in place. Alternatively, a ledge shape may be formed into the inner pipe 16 when the inner pipe 16 is manufactured, such that the shoulder member 34 is eliminated and the number of parts reduced. The plate 20 can then be welded or otherwise fixed to the upper portion 22 of the inner pipe 16. The inner pipe 16 is then coupled to the exhaust manifold. The outer pipe includes an elbow joint 44 assembled around the lower bend 42 in the inner pipe 16. Insulation 26 can then be wrapped around the inner pipe 16 to help reduce the temperature of the lower portion of the outer pipe 24 during operation. The outer pipe 24 is then slid down over the inner pipe 16 and coupled to the elbow joint 44. Holes 46 formed in the outer pipe 24 become aligned with the ledge means 34 when the outer pipe 24 is fixed to the elbow joint 44. The outer pipe 24 can then be spot welded to the ledge means 34 via the holes 46 in the outer pipe 24. The ledge means 34 and spot welds 48 help prevent the outer pipe 24 from rattling against the inner pipe 16 during operation.

Referring now to FIG. 4, there is shown an alternative embodiment of the present invention. The alternative embodiment provides a plate 120 that is carried at an angle approximately 45° from a horizontal plane. The plate 120 generally covers the inner pipe's upper opening 18 such that the amount of rainwater that enters the inner pipe 16 is reduced. The plate 120 does not extend outwardly beyond the periphery of the inner pipe, and therefore allows exhaust gases to flow upwardly around the plate 120 more freely. Similarly, the positioning of the plate 120 at an angle allows exhaust gases to flow upwardly around the plate 120 rapidly. The alternative embodiment therefore causes lower back pressures in exhaust fumes and can be utilized with vehicles having larger engines.

I claim:

1. An exhaust pipe coupled with a vehicle operable in an environment, and through which exhaust gases from a vehicle power source flow into the environment, comprising:

an inner pipe extending a vertical length and through which exhaust gas flows, said inner pipe having an upper opening through which exhaust gas exits the inner pipe;

an outer pipe positioned around the inner pipe and having an upper end portion that extends beyond the upper opening in the inner pipe, said upper end portion of the outer pipe defining an outlet through which exhaust gas exits the outer pipe generally directly after exiting the inner pipe's upper opening, said outer pipe generally extending the entire vertical length of the inner pipe for generally surrounding the entire vertical length of the inner pipe;

means coupled with the inner pipe for blocking rain that has entered the outer pipe from falling through the opening in the inner pipe;

ledge means positioned beneath the upper opening in the inner pipe and between the inner and outer pipes, said ledge means, inner pipe and outer pipe forming a chamber within which is held rainwater that has entered the outer pipe; and drainage means for allowing rainwater in the chamber to pass to the environment.

2. The invention of claim 1, wherein the blocking means is positioned adjacent the upper opening in the inner pipe for preventing rain from traveling with a straight trajectory through the outer pipe outlet and the upper opening in the inner pipe.

3. The invention of claim 1, wherein:

the upper end portion of the outer pipe forms a bend; and the outer pipe includes side portions through which the outer pipe outlet opens.

4. The invention of claim 1, wherein the drainage means comprises an orifice formed in the outer pipe and adjacent the ledge means.

5. The invention of claim 1, wherein the outer pipe is welded to the ledge means.

6. The invention of claim 1, wherein the inner pipe includes a side portion through which the upper opening in the inner pipe opens.

7. The invention of claim 6, wherein the inner pipe includes an upper portion which is generally covered by the blocking means, said blocking means further comprises a plate extending laterally over and beyond the upper opening of the inner pipe.

8. The invention of claim 6, wherein the plate is carried at an angle with respect to a horizontal plane.

9. An exhaust pipe coupled with a vehicle operable in an environment, and through which exhaust gases from a vehicle power source flow into the environment, comprising:

an inner pipe extending a generally vertical length and through which exhaust gas flows, said inner pipe having an upper opening formed in a side of the inner pipe and through which exhaust gas exits the inner pipe;

an outer pipe positioned around the inner pipe and having an upper end portion that extends beyond the upper opening in the inner pipe, said upper end portion forming a bend and defining an outlet that opens to the side of the outer pipe for allowing exhaust gas to exit the outer pipe generally directly after passing through the inner pipe's upper opening, said outer pipe extending the entire vertical length of the inner pipe for generally surrounding the entire vertical length of the inner pipe;

a ledge means positioned between the inner and outer pipes and positioned a distance beneath the upper opening in the inner pipe, said ledge means, inner pipe and outer pipe forming a chamber within which is held rainwater that has entered the outer pipe;

an orifice formed in the outer pipe and adjacent the ledge means, said orifice allowing rainwater held in the chamber to pass to the environment;

a plate positioned to form a cover for the upper portion of the inner pipe, said plate also extending laterally over the upper opening of the inner pipe for blocking rainwater that has entered the outer pipe from falling through the opening in the inner pipe.

10. The invention of claim 1, and further comprising insulation positioned between the inner and outer pipes and beneath the ledge means.

11. The invention of claim 9, and further comprising insulation positioned between the inner and outer pipes and beneath the ledge means.

12. An exhaust pipe coupled with a vehicle operable in an environment, and through which exhaust gases from a vehicle power source flow into the environment, comprising:

an inner pipe having a lower end portion coupled with the vehicle power source for receiving exhaust fumes therefrom, and an upper portion vertically spaced from the lower end portion, said inner pipe extending a vertical length and having an upper opening formed in the upper end portion through which exhaust gas exits the inner pipe;

an outer pipe positioned around the inner pipe and having a lower end portion that generally surrounds and encloses the entire lower end portion of the inner pipe, and an upper end portion that extends beyond the inner pipe's upper end portion and upper opening, said outer pipe's upper end portion defining an outlet through which exhaust gas exits the outer pipe, said outer pipe extending for the entire vertical length of the inner pipe for generally surrounding the entire vertical length of the inner pipe;

means coupled with the inner pipe for blocking rain that has entered the outer pipe from falling through the upper opening in the inner pipe;

ledge means positioned beneath the upper opening in the inner pipe and between the inner and outer pipes, said ledge means, inner pipe and outer pipe forming a chamber within which is held rainwater that has entered the outer pipe; and drainage means for allowing rainwater in the chamber to pass to the environment.

13. The invention of claim 12, and further comprising insulation positioned between the inner and outer pipes and beneath the ledge means.

14. The invention of claim 12, wherein the blocking means is positioned adjacent the upper opening in the inner pipe for preventing rain from traveling with a straight trajectory through the outer pipe outlet and the upper opening in the inner pipe.

15. The invention of claim 12, wherein:

the upper end portion of the outer pipe forms a bend; and the outer pipe includes side portions through which the outer pipe outlet opens.

16. The invention of claim 12, wherein the drainage means comprises an orifice formed in the outer pipe and adjacent the ledge means.

17. The invention of claim 12, wherein the outer pipe is welded to the ledge means.

18. The invention of claim 12, wherein the inner pipe includes a side portion through which the upper opening in the inner pipe opens.

19. The invention of claim 16, and further comprising insulation positioned between the inner and outer pipes and beneath the ledge means.

20. The invention of claim 12, wherein exhaust gas exits the outer pipe's outlet generally directly after passing through the inner pipe's upper opening.

21. The invention of claim 19, wherein the upper portion of the inner pipe is generally covered by the blocking means, said blocking means further comprises a plate positioned to extend laterally over and beyond the upper opening of the inner pipe.

22. The invention of claim 19, wherein the plate is carried at an angle with respect to a horizontal plane.

23. An exhaust pipe coupled with a vehicle operable in an environment, and through which exhaust gases from a vehicle power source flow into the environment, comprising:

an inner pipe extending a vertical length and through which exhaust gas flows, said inner pipe having an upper opening through which exhaust gas exits the inner pipe;

an outer pipe positioned around the inner pipe and having an upper end portion that extends beyond the upper opening in the inner pipe, said upper end portion of the outer pipe defining an outlet through which exhaust gas exits the outer pipe generally directly after exiting the inner pipe's upper opening;

means coupled with the inner pipe for blocking rain that has entered the outer pipe from falling through the opening in the inner pipe;

ledge means positioned beneath the upper opening in the inner pipe and between the inner and outer pipes, said ledge means, inner pipe and outer pipe forming a chamber within which is held rainwater that has entered the outer pipe; and drainage means for allowing rainwater in the chamber to pass to the environment.

24. The invention of claim 23, and further comprising insulation positioned between the inner and outer pipes and beneath the ledge means.

* * * * *